US012446632B1

(12) United States Patent
Alyahya et al.

(10) Patent No.: US 12,446,632 B1
(45) Date of Patent: Oct. 21, 2025

(54) SOCKS FOR RECEIVING ORTHOTIC INSOLES

(71) Applicant: KING SAUD UNIVERSITY, Riyadh (SA)

(72) Inventors: Hatoun Khaled Alyahya, Riyadh (SA); Ruba Mohammed Bajunaid, Riyadh (SA); Khalid Abdullah Alhussaini, Riyadh (SA); Saleh Sulaiman Altayyar, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 0 days.

(21) Appl. No.: 18/967,517

(22) Filed: Dec. 3, 2024

(51) Int. Cl.
*A41B 11/00* (2006.01)
*A41B 11/12* (2006.01)

(52) U.S. Cl.
CPC ..... *A41B 11/008* (2013.01); *A41B 11/123* (2013.01); *A41B 2300/22* (2013.01); *A41B 2300/32* (2013.01); *A41B 2300/322* (2013.01)

(58) Field of Classification Search
CPC ..... A41B 11/006; A41B 11/007; A41B 11/02; A41B 11/04; A61F 5/0116; A61F 5/0111; A43B 3/101; A43B 7/28; A43B 17/18
See application file for complete search history.

(56) References Cited

U.S. PATENT DOCUMENTS 4,316,333 A * 2/1982 Rothschild ..... A43B 17/18 36/91
5,501,659 A * 3/1996 Morris ..... A61F 5/0111 602/65
5,553,399 A * 9/1996 Strong ..... A43B 3/16 36/7.1 R
RE40,363 E * 6/2008 Grim ..... A43B 7/20 36/95
8,056,149 B2 * 11/2011 Duclos ..... A43B 23/07 36/109
9,968,138 B1 * 5/2018 Williams, Sr. ..... A41B 11/02
11,805,852 B1 * 11/2023 Mosher ..... A61F 5/0111
2001/0034956 A1 * 11/2001 Mawusi ..... A43B 7/141 36/10

(Continued)

OTHER PUBLICATIONS

Amazon Website "Ankle Brace for Women & Men—Ankle Support Sprained Ankle Brace for Achilles, Tendon, Sprain, Injury Recovery, Ankle Support Brace for Running, Basketball, Football (Black,L,Left)", First available online Oct. 18, 2022.

(Continued)

*Primary Examiner* — Jillian K Pierorazio
(74) *Attorney, Agent, or Firm* — Nath, Goldberg & Meyer; Joshua B. Goldberg

(57) ABSTRACT

The socks for receiving orthotic insoles are footwear adapted for holding orthotic insoles in environments where the wearer cannot wear shoes, such as in yoga studios, places of worship, and the like. Each sock includes a tubular body having a top side, a bottom side, a closed end and an open end. A pair of straps may be secured to the tubular body, and the pair of straps are sized, positioned and configured for wrapping around the wearer's ankle. At least one layer of frictionally engaging material is secured to the bottom side of the tubular body for frictionally engaging with the floor or a similar support surface. The interior of the tubular body is adapted for receiving an orthotic insole.

4 Claims, 8 Drawing Sheets

(56) References Cited

U.S. PATENT DOCUMENTS

2004/0045195 A1* 3/2004 Long ..... A43B 7/147 36/88
2005/0073073 A1 4/2005 Graf et al.
2007/0074428 A1* 4/2007 Roudebush ..... A43B 3/101 36/9 R
2007/0293798 A1* 12/2007 Hu ..... A61F 5/0195 602/27
2009/0227927 A1* 9/2009 Frazer ..... A61F 5/34 602/27
2012/0240429 A1* 9/2012 Sokolowski ..... A43C 11/1493 36/50.1
2013/0289463 A1* 10/2013 Watts ..... A61F 5/0111 602/27
2014/0041099 A1* 2/2014 Boyd ..... A41B 11/125 2/239
2014/0249460 A1* 9/2014 Gaylord ..... A61F 5/0111 602/27
2015/0223553 A1* 8/2015 Ardell ..... A43C 11/002 36/85
2015/0223554 A1* 8/2015 Ardell ..... A43C 15/005 36/105
2015/0230551 A1* 8/2015 O'Brien ..... A43B 17/105 12/146 B
2017/0181477 A1* 6/2017 Saddler ..... A41B 11/007
2018/0208123 A1* 7/2018 Caslowitz ..... A44B 11/00
2018/0352904 A1* 12/2018 Garzon ..... A43C 11/1493
2019/0008693 A1* 1/2019 Malinsky ..... A61F 5/0127
2019/0075890 A1* 3/2019 Wright ..... A43B 23/28
2019/0297992 A1* 10/2019 Raza ..... A61F 5/0116
2020/0205483 A1* 7/2020 Burns ..... A41B 11/02
2020/0337385 A1* 10/2020 Scott ..... A43B 3/166
2020/0383387 A1* 12/2020 Lee ..... A41B 11/121
2021/0251793 A1* 8/2021 Romo ..... A61F 5/0585
2021/0274857 A1* 9/2021 Kim ..... A41B 11/008
2021/0274879 A1 9/2021 Lohne et al.
2024/0206594 A1* 6/2024 Mckenzie-Harbor ..... A43B 17/18

OTHER PUBLICATIONS

Amazon Website "Gaiam Yoga Barre Socks —Non Slip Sticky Toe Grip Accessories for Women & Men", First available online Feb. 17, 2021.
Amazon Website "Hemoton Plaster Warm Shoe Cover Orthopedic Shoes Walking Shoe Cover Foot cast Shoes cast Sock Boot Fracture Orthotics for Plantar Broken Toe Walking Shoes Sole of Foot Walker pu", First available online May 1, 2023.
Amazon Website "ORTHOS Orthotic Replacement Shoe Insoles—USA Made—Breathable Full Length Feet Insoles with Shock Absorption for Arch Support, Flat Feet, Heel Spurs, Plantar Fasciitis", First available online Jun. 5, 2020.
Amazon Website "PCSsole 220+lbs Heavy Duty High Arch Support Insoles, Comfort Orthotics Insoles for Plantar Fasciitis, Flat Feet, Heel Pain, Pronation, Foot Pain Relief, Comfortable Shoe Insert for Men Women", First available online Apr. 8, 2024.
DeRoyal Industries, "DeRoyal® Sports Orthosis Powered by the BOA® Fit System", YouTube Video, First available online Jan. 23, 2015.
Lee et al., "A New Ankle-Foot Orthosis Using Wire for Stroke Patients with Foot Drop", Lermagazine.com, First available online Jan. 28, 2021.

* cited by examiner

SOCKS FOR RECEIVING ORTHOTIC INSOLES

BACKGROUND

Field

The disclosure of the present patent application relates to footwear, and particularly to socks adapted for receiving orthotic insoles.

Description of Related Art

Orthotic insoles are removable shoe inserts which are used for a wide variety of purposes, including daily wear comfort, height enhancement, plantar fasciitis treatment, arch support, foot and joint pain relief from arthritis, overuse, injuries, leg length discrepancy, and other causes such as orthopedic correction and athletic performance. Orthotic insoles are typically designed specifically for insertion into shoes. However, there are numerous circumstances in which a user of orthotics cannot wear shoes and, as such, cannot enjoy the benefits of the orthotic insoles. For example, yoga studios, places of worship, martial arts dojos and the like may require the removal of shoes. Such environments, however, often allow people to still wear socks and similar footwear. A conventional sock, however, is not adapted for holding an orthotic insole in place when worn. Thus, socks for receiving orthotic insoles solving the aforementioned problems are desired.

SUMMARY

The socks for receiving orthotic insoles are footwear adapted for holding orthotic insoles in environments where the wearer cannot wear shoes, such as in yoga studios, places of worship, and the like. In one embodiment, each sock includes a tubular body having a top side, a bottom side, a closed end and an open end. A pair of straps are secured to the tubular body, and the pair of straps are sized, positioned and configured for wrapping around the wearer's ankle. At least one layer of frictionally engaging material is secured to the bottom side of the tubular body for frictionally engaging with the floor or a similar support surface. The interior of the tubular body is adapted for receiving an orthotic insole. The open end of the tubular body may be defined by a fabric rim, and the fabric rim may have an elastic band embedded therein.

A closure, such as a hook and loop fastener, as a non-limiting example, may be provided for releasably securing the pair of straps to one another. Additionally, each of the straps may have a wire embedded therein for holding a desired shape of the straps and/or providing additional support for the wearer's ankle. A retainer may be secured within the tubular body for releasably holding the orthotic insole.

In an alternative embodiment, the sock for receiving orthotic insoles includes a tubular body having a top side, a bottom side, a closed end and an open end, where the top side has a pair of flaps adjacent the open end. A closure, such as a zipper, as a non-limiting example, is provided for releasably closing the pair of flaps. At least one layer of frictionally engaging material is secured to the bottom side of the tubular body for frictionally engaging with a floor. The interior of the tubular body is adapted for receiving an orthotic insole. Additionally, an elastic band may be secured within the tubular body adjacent to the open end.

A retainer may be secured within the tubular body for releasably holding the orthotic insole. The retainer, as a non-limiting example, may include at least one strap. The at least one strap may have a wire embedded therein for maintaining a shape and position of the at least one strap when the sock is worn.

These and other features of the present subject matter will become readily apparent upon further review of the following specification.

BRIEF DESCRIPTION OF DRAWINGS

Similar reference characters denote corresponding features consistently throughout the attached drawings.

DETAILED DESCRIPTION

Figure 1A:
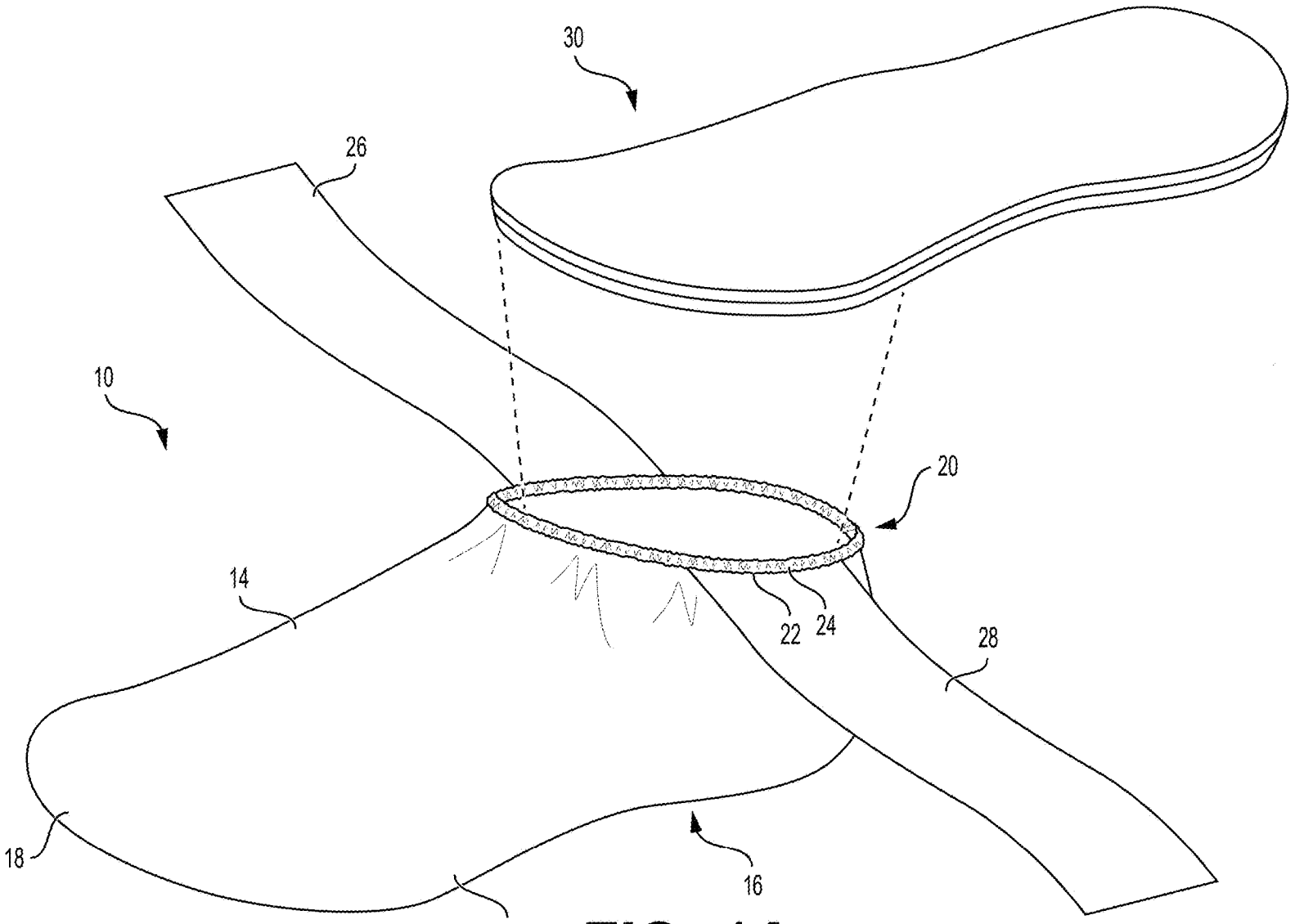
FIG. 1A is a perspective view of a sock for receiving orthotic insoles.
Figure 1B:
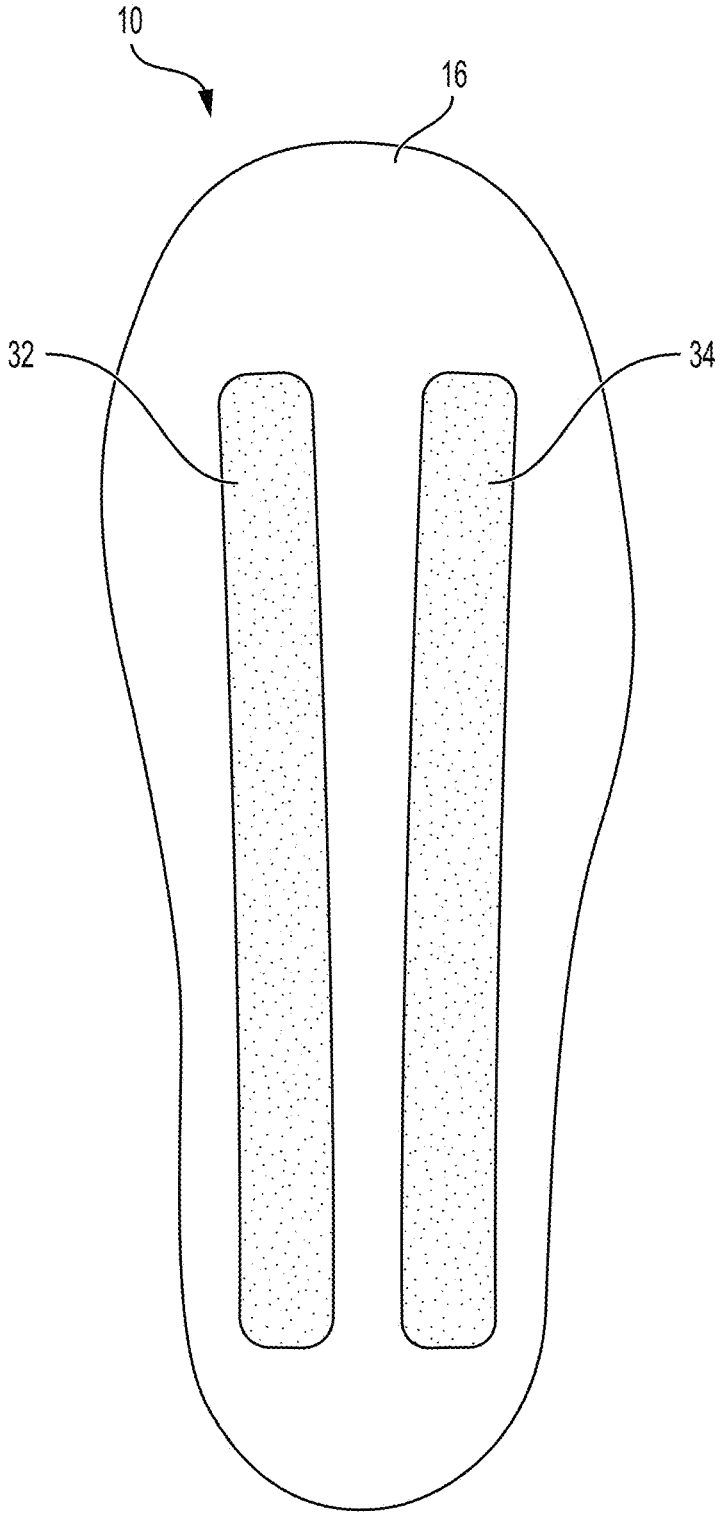
FIG. 1B is a bottom view of the sock for receiving orthotic insoles.

The socks for receiving orthotic insoles are footwear adapted for holding orthotic insoles in environments where the wearer cannot wear shoes, such as in yoga studios, places of worship, and the like. In the embodiment of FIGS. 1A and 1B, each sock 10 includes a tubular body 12 having a top side 14, a bottom side 16, a closed end 18 and an open end 20. Although only a single sock 10 is shown, it should be understood that socks are typically provided in pairs and that an identical sock may be provided with the illustrated sock 10. It should be further understood that the overall style, size and relative dimensions of sock 10 is shown for exemplary purposes and may be varied in a manner well-known in the manufacture of socks and other apparel. It should be further understood that the tubular body 12 may be made out of any suitable material, as is well-known in the field of sock manufacture.

A pair of straps 26, 28 are secured to the tubular body 12, and the pair of straps 26, 28 are sized, positioned and configured for wrapping around the wearer's ankle. It should be understood that the overall size, shape and relative dimensions of the pair of straps 26, 28 are shown for exemplary purposes only. As shown in FIG. 1B, at least one layer of frictionally engaging material is secured to the bottom side 16 of the tubular body 12 for frictionally engaging with the floor or a similar support surface. Although a pair of strips 32, 34 are shown, it should be understood that the layer of frictionally engaging material may have any desired size and shape and may be provided in any number of individual strips or other portions of the layer. It should be further understood that any suitable type of gripping material, such as rubber or the like, may be used. Returning to FIG. 1A, the interior of the tubular body 12 is adapted for receiving an orthotic insole 30. The open end 20 of the tubular body 12 may be defined by a fabric rim 22, and the fabric rim 22 may have an elastic band 24 embedded therein for securing the fabric rim 22 about the ankle of the wearer.

Figure 2A:
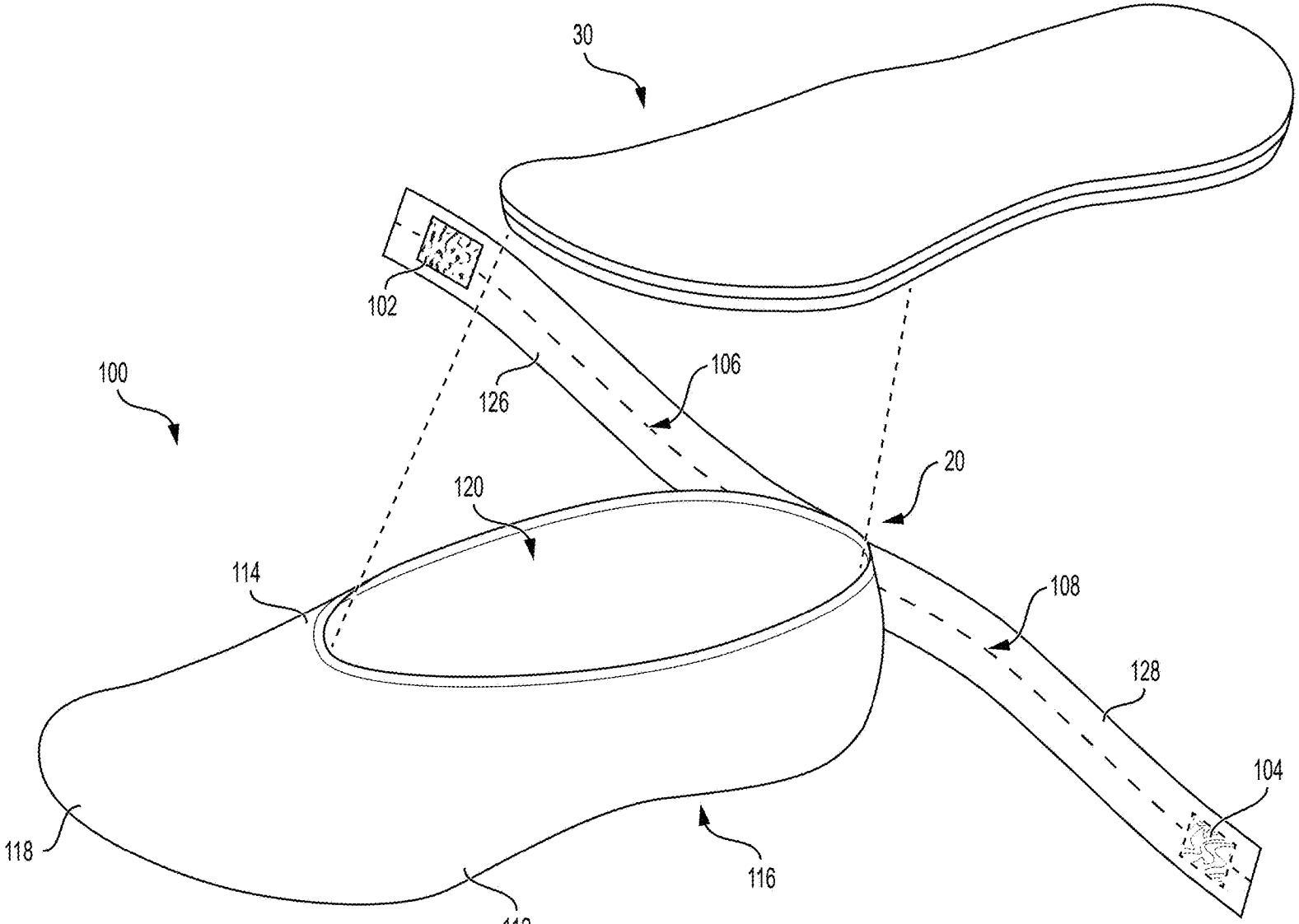
FIG. 2A is a perspective view of an alternative embodiment of the sock for receiving orthotic insoles.
Figure 2B:
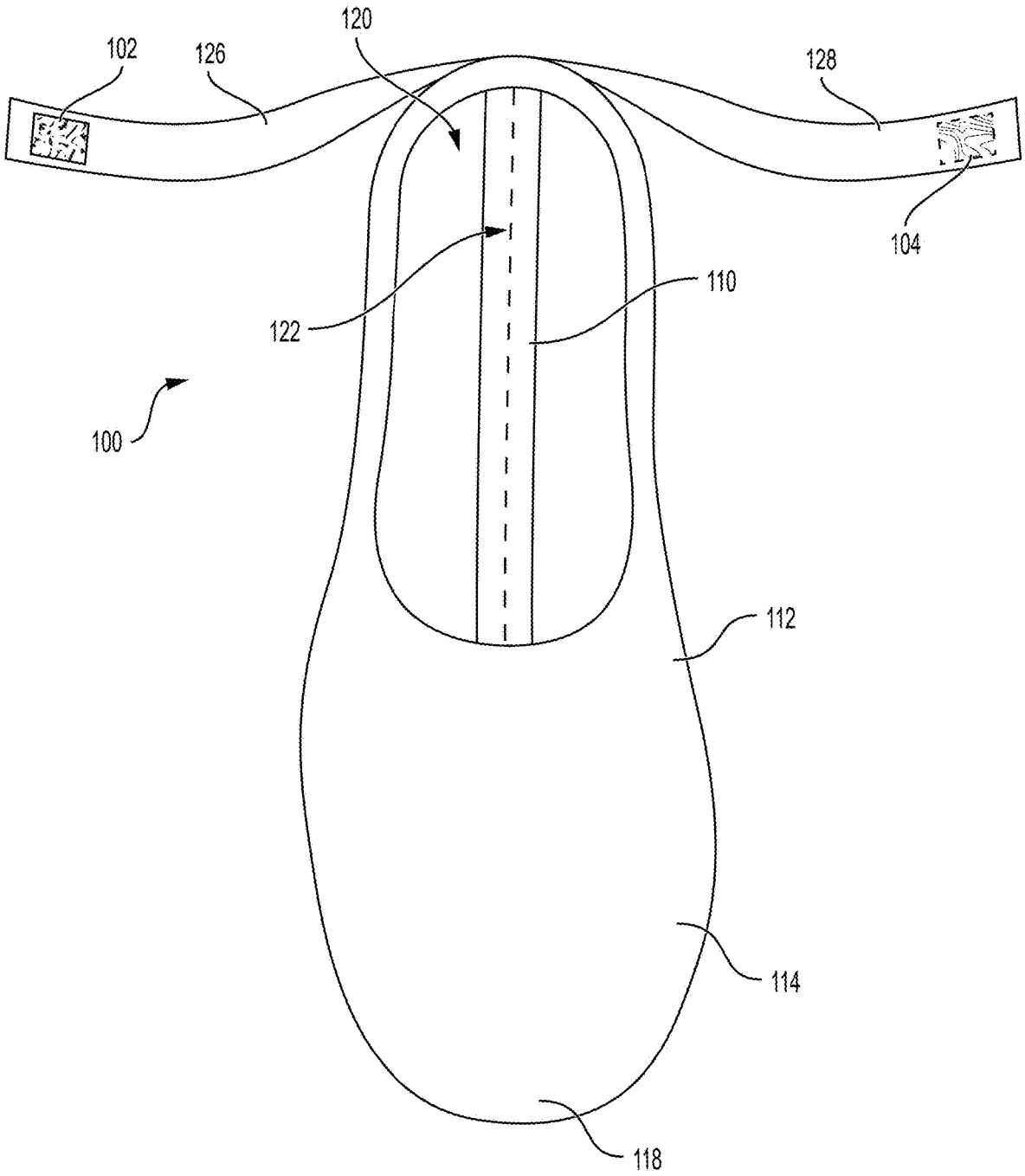
FIG. 2B is a top view of the sock for receiving orthotic insoles of FIG. 2A.
Figure 2C:
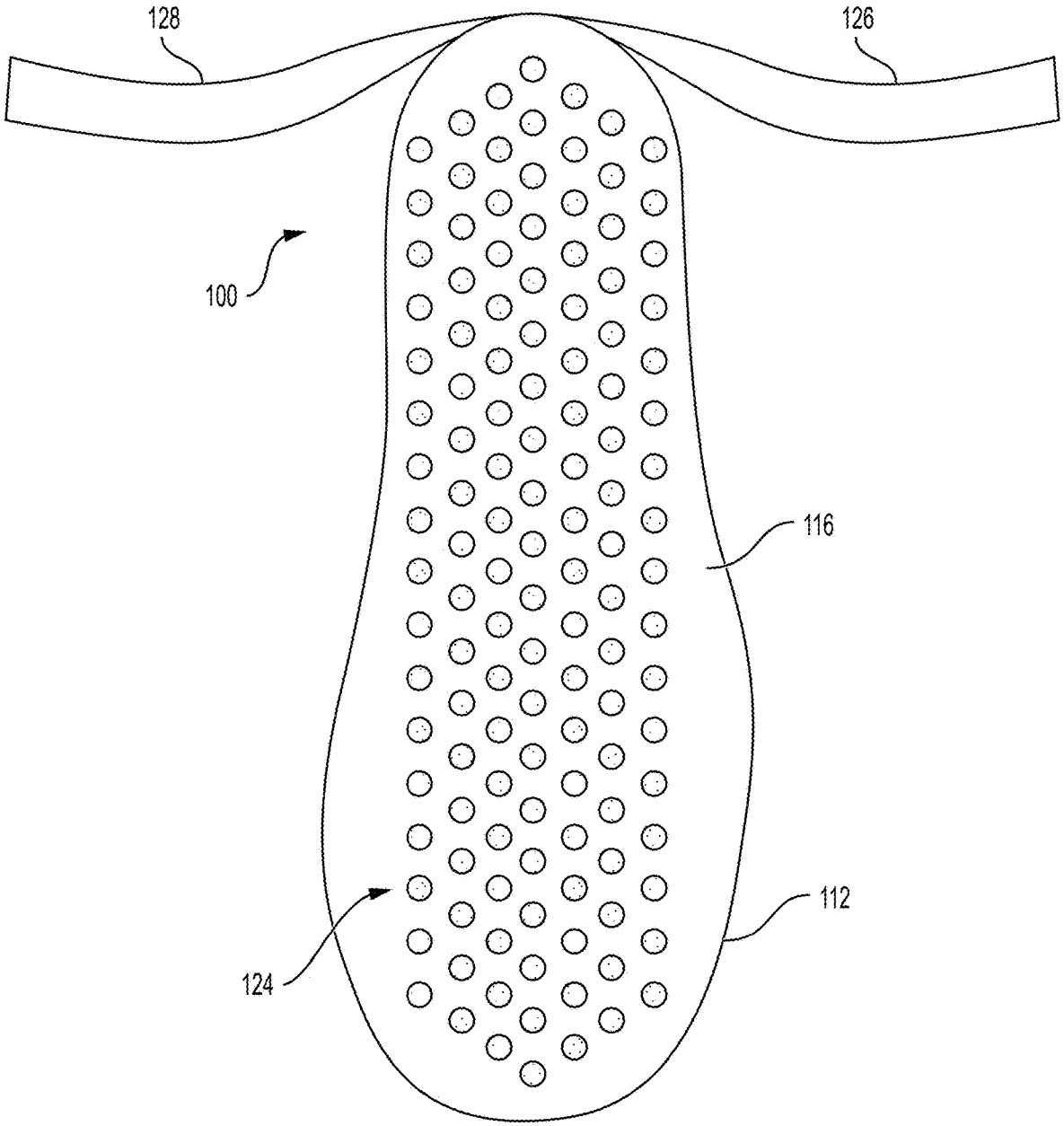
FIG. 2C is a bottom view of the sock for receiving orthotic insoles of FIG. 2A.

In the embodiment of FIGS. 2A, 2B and 2C, each sock 100 similarly includes a tubular body 112 having a top side 114, a bottom side 116, a closed end 118 and an open end 120. A pair of straps 126, 128 is secured to the tubular body 112, and the pair of straps 126, 128 are sized, positioned and configured for wrapping around the wearer's ankle. Although straps 126, 128 are shown having different dimensions and different positions than straps 26, 28 of the previous embodiment, it should be understood that the overall size, shape, relative dimensions and positioning of the pair of straps 126, 128 are shown for exemplary purposes only. A closure, such as a hook and loop fastener 102, 104, as a non-limiting example, may be provided for releasably securing the pair of straps 126, 128 to one another. It should be understood that any suitable type of closure or fastener may be used. Additionally, each of the straps 126, 128 may have a wire 106, 108, respectively, embedded therein for holding a desired shape of the straps 126, 128 and/or providing additional support for the wearer's ankle.

As shown in FIG. 2B, a retainer 110 may be secured within the tubular body 112 for releasably holding the orthotic insole 30. Although retainer 110 is shown as a fabric strip with a wire 112 embedded therein, it should be understood that any suitable type of retainer may be used for releasably securing orthotic insole 30 within the sock 100 and preventing its movement when the sock 100 is worn.

As shown in FIG. 2C, at least one layer of frictionally engaging material is secured to the bottom side 116 of the tubular body 112 for frictionally engaging with the floor or a similar support surface. Although the layer 124 is shown as a plurality of dots made from, for example, rubber or the like, it should be understood that the layer of frictionally engaging material may have any desired size and shape and may be provided in any suitable overall configuration. It should be further understood that any suitable type of gripping material, such as rubber or the like, may be used.

Figure 3A:
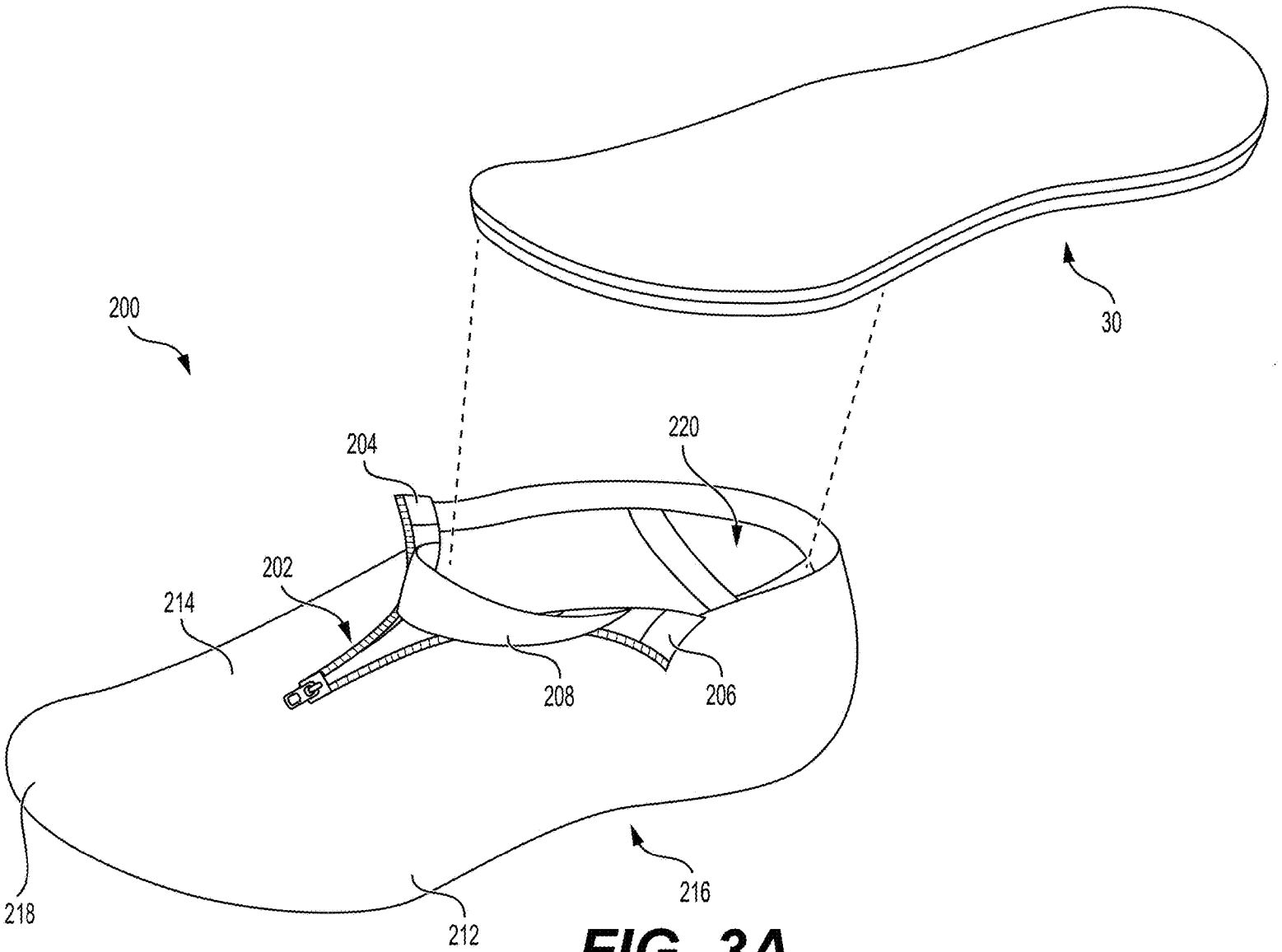
FIG. 3A is a perspective view of another alternative embodiment of the sock for receiving orthotic insoles.
Figure 3B:
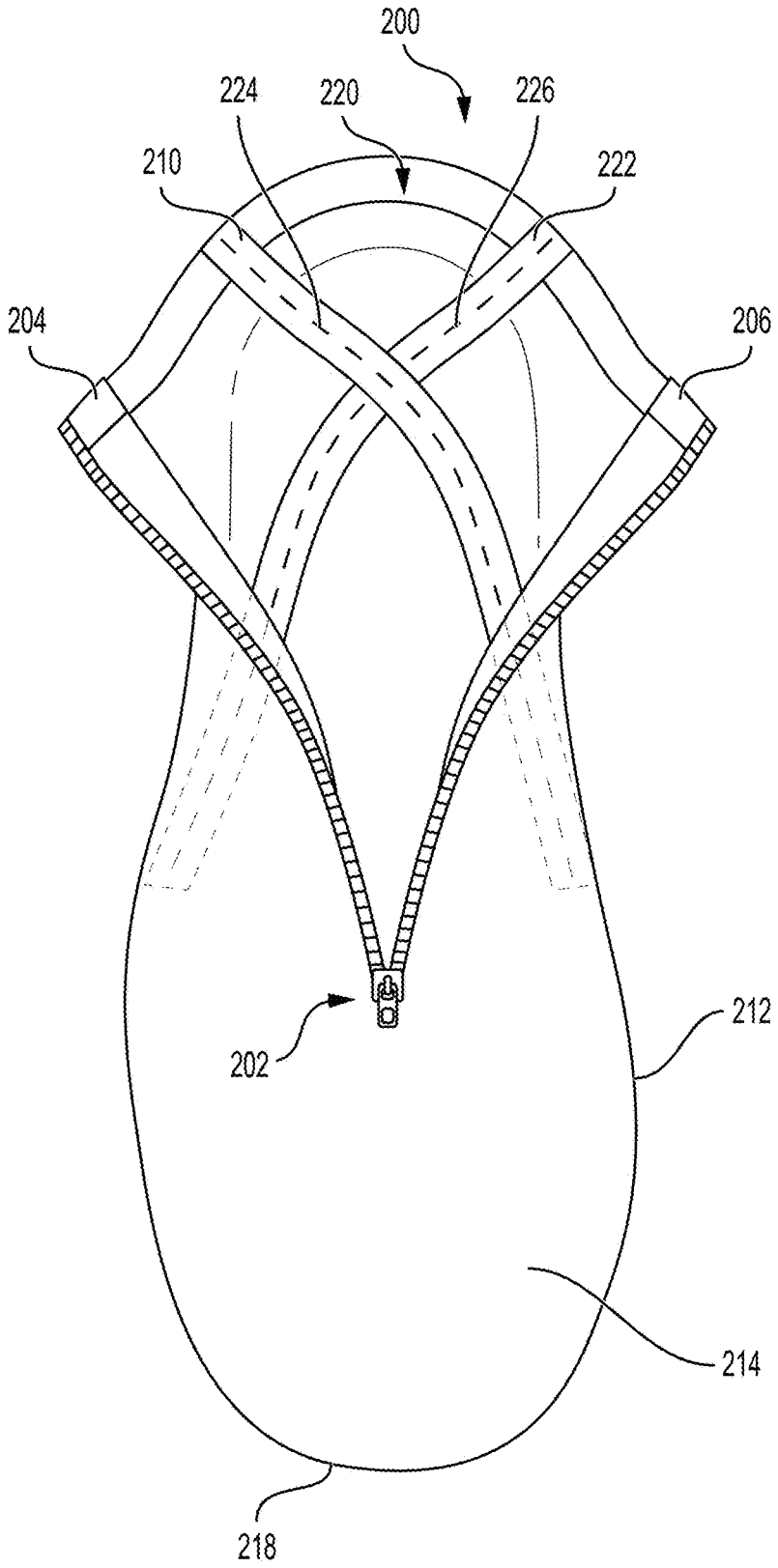
FIG. 3B is a top view of the sock for receiving orthotic insoles of FIG. 3A.
Figure 3C:
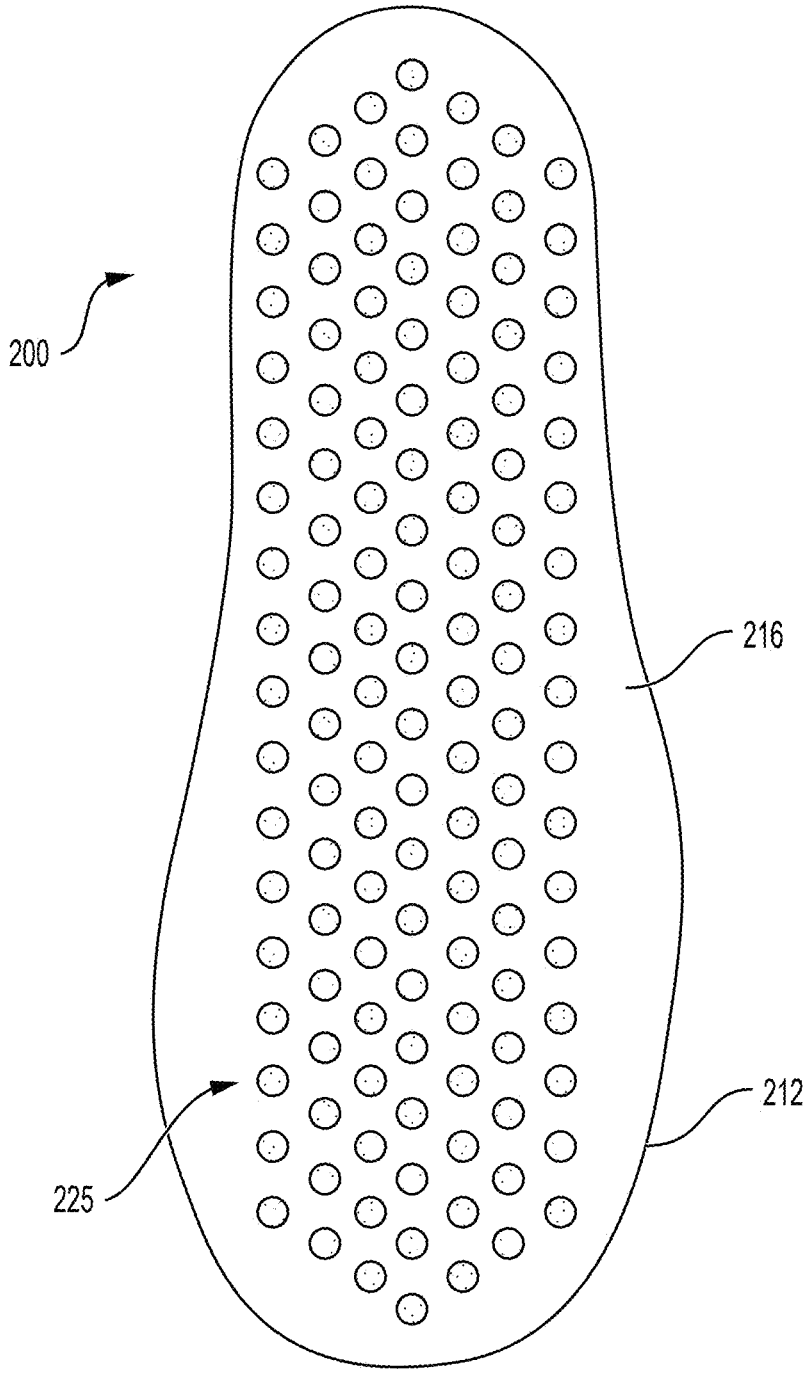
FIG. 3C is a bottom view of the sock for receiving orthotic insoles of FIG. 3A.

In the alternative embodiment of FIGS. 3A, 3B and 3C, the sock for receiving orthotic insoles 200 also includes a tubular body 212 having a top side 214, a bottom side 216, a closed end 218 and an open end 220. However, as shown in FIG. 3A, the top side 214 has a pair of flaps 204, 206 adjacent the open end 220. A closure 202, such as a zipper, as a non-limiting example, is provided for releasably closing the pair of flaps 204, 206. It should be understood that any suitable type of releasable fastener may be used. The interior of the tubular body 212 is adapted for receiving an orthotic insole 30. Additionally, an elastic band 208 may be secured within the tubular body 212 adjacent the open end 220 for securing the wearer's ankle.

For purposes of clarity and illustration, FIG. 3B shows the sock 200 without the elastic band 208. As shown, a retainer may be secured within the tubular body 212 for releasably holding the orthotic insole 30. In the non-limiting example of FIG. 3B, the retainer includes two straps 210, 222. Each of the straps may have a wire 224, 226, respectively, embedded therein for maintaining a shape and position of the straps 210, 222 when the sock 200 is worn. It should be understood that the size, shape, relative dimensions and positioning of the straps 210, 222 are shown for exemplary purposes and may be varied. Similarly, although two straps are illustrated, it should be understood that any suitable number of straps, including a single strap, may be used to secure the orthotic insole 30 within the tubular body 212.

As shown in FIG. 3C, similar to the previous embodiments, at least one layer of frictionally engaging material is secured to the bottom side 216 of the tubular body 212 for frictionally engaging with the floor or a similar support surface. Although the layer 225 is shown as a plurality of dots made from, for example, rubber or the like, it should be understood that the layer of frictionally engaging material may have any desired size and shape and may be provided in any suitable overall configuration. It should be further understood that any suitable type of gripping material, such as rubber or the like, may be used.

It is to be understood that the socks for receiving orthotic insoles are not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

The invention claimed is:

1. A sock for receiving orthotic insoles, comprising:

a tubular body having a top side, a bottom side, a closed end and an open end, the top side having a pair of flaps adjacent the open end;

a closure for releasably closing the pair of flaps;

at least one layer of frictionally engaging material secured to the bottom side of the tubular body, the at least one layer of frictionally engaging material being adapted for frictionally engaging with a floor;

a retainer secured within the tubular body, wherein the retainer comprises a pair of straps, each of the straps having a heel end secured to a rim of the open end of the tubular body, wherein an interior of the tubular body is adapted for receiving an orthotic insole, and wherein the retainer is adapted for releasably holding the orthotic insole.

2. The sock for receiving orthotic insoles as recited in claim 1, further comprising an elastic band secured within the tubular body adjacent the open end.

3. The sock for receiving orthotic insoles as recited in claim 1, wherein the closure comprises a zipper.

4. The sock for receiving orthotic insoles as recited in claim 1, wherein each of the straps of the retainer has a wire embedded therein.

* * * * *